US005153538A

United States Patent [19]

Kane

[11] Patent Number: 5,153,538

[45] Date of Patent: Oct. 6, 1992

[54] MICROWAVE EDGE GUIDE MODE SIGNAL SPLITTER AND COMBINER

[75] Inventor: Robert C. Kane, Woodstock, Ill.

[73] Assignee: Motorola, Inc., Schaumburg, Ill.

[21] Appl. No.: 714,490

[22] Filed: Jun. 13, 1991

[51] Int. Cl.[5] ..... H01P 5/12

[52] U.S. Cl. ..... 333/128; 333/1.1

[58] Field of Search ..... 333/1.1, 128

[56] References Cited

U.S. PATENT DOCUMENTS 3,555,459 1/1971 Anderson ..... 333/1.1

3,967,218 6/1976 McGowan ..... 333/1.1

*Primary Examiner*—Paul Gensler

*Attorney, Agent, or Firm*—Joseph P. Krause

[57] ABSTRACT

A broad-band microwave waveguide radio frequency splitter and combiner (70 and 100) can be realized by using TEM mode wave propagation to edge guide mode wave propagation conversion performed by magnetically biased material (16) and directionally opposed magnetic fields (20 and 22) and a waveguide such as a microstrip (10) or a stripline (50) to spatially separate a TEM mode signal into two or more components.

11 Claims, 2 Drawing Sheets

MICROWAVE EDGE GUIDE MODE SIGNAL SPLITTER AND COMBINER

FIELD OF THE INVENTION

This invention relates to devices used with microwave radio signals. More particularly, this invention relates to devices that split and combine microwave signals.

BACKGROUND OF THE INVENTION

Microwave transmission lines are well known in the art. These so-called waveguides include the well-known rectangularly cross sectioned hollow pipe wave guide through which radio frequency waves propagate from a source to a destination. Microwave transmission lines also include the so-called stripline and microstrip waveguides (also considered transmission lines) as well.

A microwave stripline transmission line is generally comprised of three conductors; a center conductor generally lies between two layers of dielectric material both of which lie between two outer, ground-plane conductors. A microstrip transmission line on the other hand generally consists of a layer of dielectric material between two conductive strips.

Stripline and microstrip transmission line are well known in the art. They have many specific uses but, one electronic device or circuit to another.

In many radio communications applications it is desirable to be able to split a radio frequency signal into one or more reduced amplitude signals. At high frequencies (microwave frequencies generally above 1 gigahertz Ghz.) a so-called signal splitter generally takes the form of a discrete or distributed quarter wavelength section of transmission line or waveguide in a "T" configuration. A single input port device with two output ports electrically splits an input signal into two components, one output from each of two output ports. In addition to splitting a radio frequency signal, it is frequently desirable to be able to combine two radio frequency signals at microwave frequencies, such as where the signals from one or more antennas are combined to a single input port of a radio receiver. Like splitters, prior art combiners typically employed two or more quarter wavelength sections tied together at one common point to implement such a radio frequency combiner.

A problem with prior art quarter-wavelength microwave splitters and combiners is their relatively narrow bandwidth, frequency-dependent operating characteristics. Quarter-wavelength stubs that comprise a microwave signal splitter or combiner will in fact have an electrical length of a quarter wave at substantially one frequency. If the frequency of an input signal changes appreciable from the frequency at which the electrical length of the stubs is a quarter wave long, the operating characteristics of the splitter or combiner might change appreciably.

A radio frequency splitter or combiner which has reduced frequency dependency (one that is more broad band) would be an improvement over the prior art.

SUMMARY OF THE INVENTION

There is disclosed herein a passive circuit element that, depending upon its topology, may function as either a radio frequency signal combiner or a radio frequency signal splitter. In either application, the device is comprised of sections of microwave transmission line constructed to convert a well-known TEM-mode propagating wave to the so-called edge guide mode wave. (Edge strengths of which are greater near the outer edges of the waveguide than they are in the center of the waveguide. Of necessity, a waveguide that carries edge-guide mode waves must have non-zero field strengths at the edges of the waveguide.)

In the splitter, an input TEM-mode wave is converted to at least two, edge-guided mode propagating waves that are spatially separated from each other in a second section of microwave transmission line whereat the two spatially separated signals are coupled into other separate transmission paths. In the combiner, two input signals from separate transmission lines, are combined as edge-guide mode signals to a single output signal, which might be either a single edge guide mode signal or a TEM mode signal.

Figure 6:
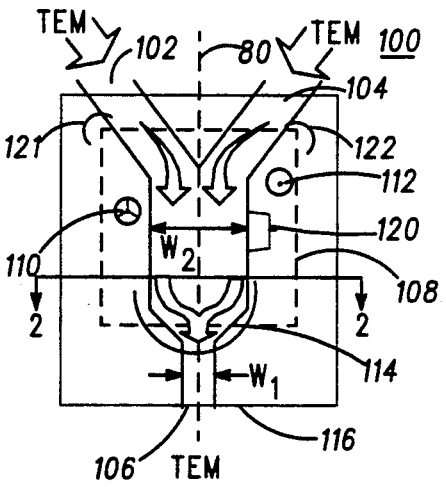
FIG. 6 shows a top view of the pattern of the conductors used to construct a radio frequency signal combiner.
Figure 5A:
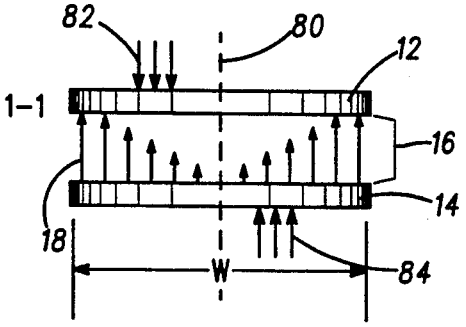
FIG. 5A shows a cross-sectional view of the electric field distribution in the transmission line depicted in FIG. 5, through section lines 1—1.

FIG,. 6A shows a cross-sectional view of the electric field intensity in the waveguide shown in FIG. 6 through section lines 2—2.

DESCRIPTION OF A PREFERRED EMBODIMENT

Figure 1:
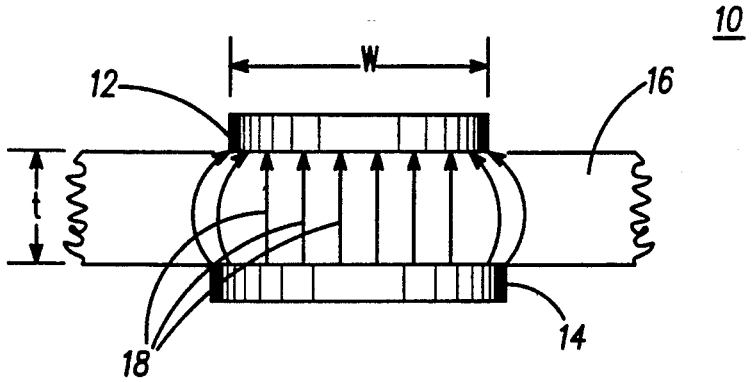
FIG. 1 shows a cross-sectional view of a microstrip transmission line and the electric field distribution of a TEM mode propagating wave signal.

FIG. 1 shows a cross-sectional view of a microstrip transmission line (10). The microstrip transmission line (10) is comprised of two conductive layers (12 and 14) separated by a dielectric layer (16).

The electrode (12) of the microstrip transmission line (10) shown in FIG. 1 has a width, W as shown and is separated from the other electrode (14) by the thickness, t of the dielectric layer (16). In most applications, one electrode layer (12 or 14) will generally be a ground plane on a circuit board and the opposing electrode (14 or 12) can be considered a signal electrode. Those skilled in the art will recognize that the designation of one electrode (12 or 14) as a signal electrode with the opposing electrode (14 or 12) being considered a ground electrode is somewhat arbitrary and made generally as a matter of notation since both electrodes are required, and are required to be within a certain physical proximity to each other with appropriate dimensions to have certain transmission line characteristics.

As shown in FIG. 1, electric field strength lines (18) depict the approximate field distribution of a TEM mode wave propagating through the microstrip transmission line. The direction of the electric field in the microstrip transmission line (10) shown in FIG. 1 is merely exemplary and one of convenience where the actual direction of propagation of a signal through such a microstrip transmission line (10) might be either into or out of the geometric plane in which FIG. 1 lies. In a normal TEM mode propagating wave, which is well known in the art, the field distribution of the propagating wave is substantially uniform across the width W of the microstrip transmission line (10) as the field lines (18) in FIG. 1 illustrate.

Figure 2:
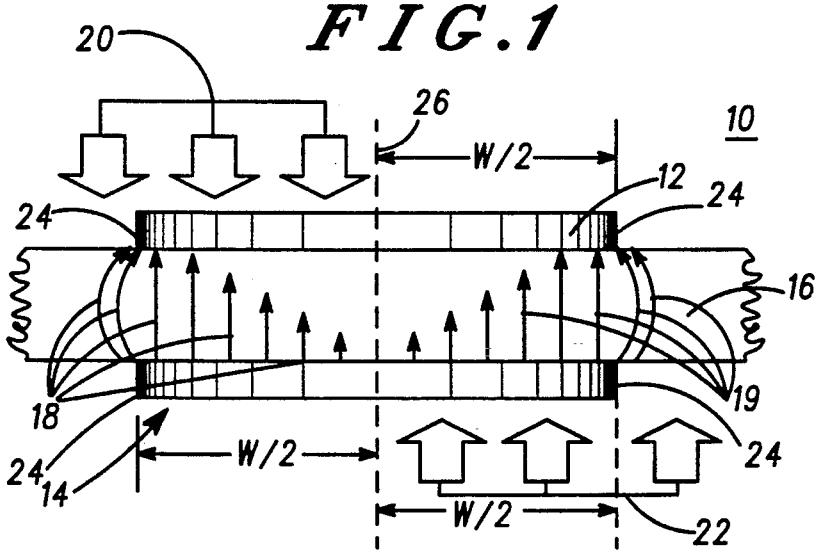
FIG. 2 shows a cross-sectional diagram of the relative electric field strength distributions of the TEM mode wave shown in FIG. 1 after being subjected to directionally opposing magnetic fields in separate halves of the transmission line which are separated along the center line of the microstrip transmission line.

It has been demonstrated in the art that when a TEM mode wave propagating through a microstrip transmission line, such as the microstrip transmission line (10) shown in FIG. 1, is subjected to a magnetic field in some direction (albeit one orthogonal to the width W of the conductors 12 and 14) and orthogonal to the direction of propagation through the waveguide (10) that the field distribution through the waveguide (10) will be urged to one side or the other of the transmission line (depending upon the orientation of the magnetic field where it extends through the waveguide and the direction of wave propagation) if the material (16) separating the electrodes (12 and 14) is magnetically biased. Stated alternatively, if there is an externally provided magnetic field existing through the material (16) separating the electrodes (12 and 14), the induced magnetic field extending through the material (16) may cause the electric field strength of a TEM mode signal propagating through the waveguide to be urged or localized to one or the other or both of the outer edges of the waveguide, as shown in FIG. 2. (Note that the length of the field lines drawn in the figures between the electrodes only indicate relative electric field strength.)

Referring now to FIG. 2, the microstrip waveguide of FIG. 1 is shown with two magnetic fields (20 and 22) induced in separate halves or portions of the microstrip transmission line (10), which halves are defined by a center line (26) that extends through the approximate geometric center of the width W of the waveguide.

The first of these magnetic fields (20) is arbitrarily depicted in FIG. 2 in a downward direction as shown. The second of these magnetic fields (22) is shown with an orientation opposite that of the first magnetic field. If the material (16) separating the electrodes (12 and 14) is properly chosen to be a dielectric material that can be magnetically biased, i.e. one with a relative magnetic permeability greater than zero, the magnetically biased material may urge or induce the dislocation of the electric field of a TEM mode wave existing between the electrodes to the outer extremes of the edges of the electrodes in the presence of the directionally opposed magnetic fields as shown in FIG. 2. (If there were only one magnetic field extending through the waveguide, electric field dislocation would occur toward only one side of the waveguide. Given a single direction of propagation of a TEM wave through the waveguide, two directionally opposed magnetic fields, spatially separated along the centerline of the waveguide, are required to convert and split the TEM propagating wave into two, edge-guide mode waves that are localized on opposite sides of the waveguide.)

The wave propagating through the microstrip (10) shown in FIG. 1 is a TEM mode wave. Its electric field strength lines are nearly uniformly distributed across the entire width W of the electrodes (12 and 14). As shown in FIG. 2, when this TEM mode wave is subjected to directionally opposed magnetic fields that are spatially separated substantially about a center line of the waveguide such that the direction of the magnetic field on one side of the transmission line is i one direction and the direction of the other magnetic field is opposing it but on the other side of the center line, the TEM mode wave will be converted into two, separate waves, the components of which are urged or induced to concentrate themselves to the outer edges of the microstrip transmission line (10) as they are shown in FIG. 2. It can be clearly seen in FIG. 2 that in the presence of the magnetic fields (20 and 22) the field lines (18) on the left side of the microstrip transmission line (10) are concentrated near the edges or corners (24) of the lower electrode (14) and the upper electrode (12) respectively. Similarly, under the influence of the second magnetic field (22) electric field lines (19) concentrate themselves to the outer edges of the upper and lower electrodes (12 and 14) respectively near the corners (24) of the right hand side of the microstrip transmission line as shown.

The phenomenon upon which the invention described herein relies, namely, the dislocation or concentration of the electric field lines from a uniform distribution across the waveguide to one edge or the other in a waveguide upon the inducement of the magnetic biasing of a dielectric material between waveguide conductors is explained in the literature. See, for example, an Article by Kane in the 1990 calendar year publication of the I.E.E.E., Proceedings of the Microwave Theory and Techniques Symposium.

Figure 3:
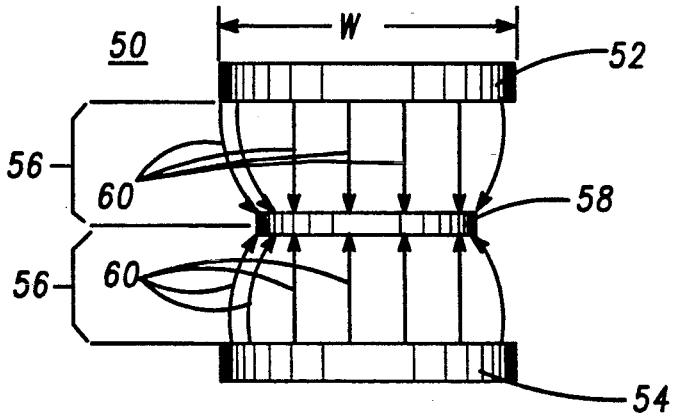
FIG. 3 shows the field distribution of a TEM mode wave in a stripline waveguide.

FIG. 3 shows a microwave stripline transmission line (50) comprised of a center conductive layer (58) bounded by two electrode layers (52 and 54) that are separated from the center conductive layer (58) by a magnetically biasable dielectric layers (56). In the absence of any external magnetic fields, the electrical field lines (60) as shown are relatively uniformly distributed about the signal conductive layer (58).

Figure 4:
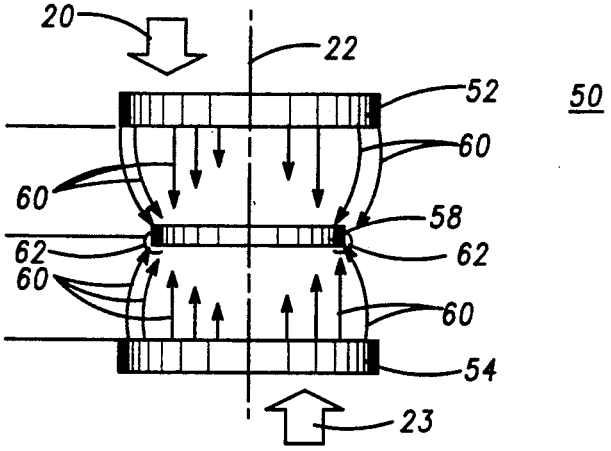
FIG. 4 shows the relative electric field strength distributions, in a stripline transmission line subjected to directionally opposing magnetic fields in separate halves of the transmission line which are separated along the center line of the stripline transmission line.

Referring now to FIG. 4, construction an imaginary center line (22) through the approximate center point of the width W of the stripline circuit (50), a magnetic field that is induced locally on the left hand side of the stripline will, as shown, effectuate the concentration of the signal field strength lines (60) to the extreme left hand outer edges of the upper and lower conductive layers (52 and 54) and to the extreme left hand edge of the center conductive layer (58) as shown. Similarly a second magnetic field (23) induced ideally on only the right hand side of the stripline conductor will cause the concentration of electric field strength near the outer most right hand region of the upper and lower conductors (52 and 54) to the right hand most section of the center conductor (58) as shown.

The extend to which a uniformly distributed TEM mode in a transmission line is displaced or urged to one side or another of the transmission line is dependent upon no less than three factors. The strength of the magnetic field induced in the waveguide will effect the degree to which TEM mode field strength lines of a signal in a transmission line will concentrate to the outside edges of the waveguide. In addition to the strength of the magnetic field, the composition of the electrode materials comprising the waveguide as well as the composition of the dielectric layer (16 in FIG. 1) will also effect the degree to which a signal will localize itself to the outside edges of the transmission line. The width (W) of the conductors will also affect how much signal remains in the relative center of a waveguide upon the inducement of a magnetic field in the waveguide. In constructing a radio frequency splitter or combiner that has desirable operating characteristics, all of these factors must be considered relevant.

Figure 5:
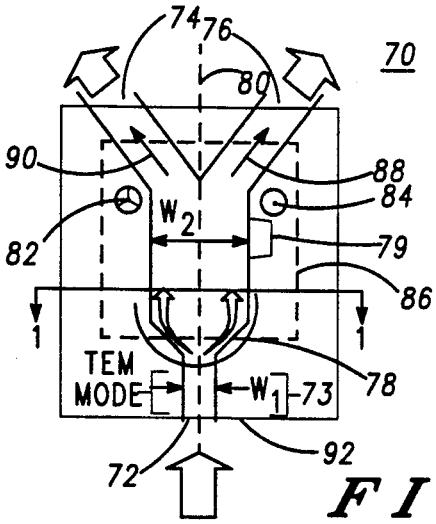
FIG. 5 shows a top view of the pattern of the conductors used to construct a radio frequency signal combiner.

Referring to FIG. 5 there is show a top view of the pattern of signal electrodes in a section of waveguide (stripline or microstrip) radio frequency signal splitter that receives a radio frequency input signal at an input port (72) as a TEM mode propagating wave. A TEM mode propagating wave will conduct itself through a first section of transmission line (73) to a second section of transmission line (78) that physically diverges the width of the input port (72) from a first dimension $W_1$ to a second width $W_2$ as shown. In a waveguide, this width spreading accomplished impedance matching. In the frequency splitter (70) shown in FIG. 5, splitting a radio frequency signal input at the input port (72) into two components that appear at the output ports (74 and 76) is accomplished by means of the phenomena described above with respect to FIGS. 2 and 4. Conversion of a TEM mode input at the input port (72) into two substantially identical magnitude edge guide mode signals is accomplished by means of induced magnetic fields that magnetically bias material in the transmission line in the waveguide splitter (70) between the input port (72) and the output ports (&4 and 76).

Converting a TEM mode input signal to edge guide mode is performed by having two directionally opposed magnetic fields (82 and 84) exist substantially in only half sections of the region generally bounded by the broken line (86). Stated alternatively, a first magnetic field with a first direction (82) exists ideally only on the left hand side of the center line (80) and is in a direction into the plane of the drawing FIG. 5. A second magnetic field (84) in a second direction, opposite the first direction, ideally exists only on the right hand side of the center line (80). Viewed along section lines 1—1 exists only on the left hand side of the center line (80) and extends completely through the electrodes (12 and 14). The first magnetic field (82) induces electrical signals propagating through the central section (79) of the radio frequency splitter and on the left-hand side of the waveguide to be converted from the TEM-mode signal to a signal that propagates along the left-hand outer edge of the conductors (12 and 14) that comprise a mode convertor or central section (79) of the frequency splitter (70). The second magnetic field (84) induces electrical signals propagating through the central section (79) of the radio frequency splitter and on the right-hand side of the waveguide to be converted from the TEM-mode signal to a signal that propagates along the right-hand outer edge of the conductors (12 and 14) that comprise a mode convertor or central section (79) of the frequency splitter (70). BY virtue of the TEM mode to edge guide mode conversion that is effected by a magnetically biased material separating two conductive layers of a waveguide, an efficient virtually frequency independent frequency splitter can be implemented.

It should be noted that as stated above, the strength of the magnetic fields (82 and 84) as well as the composition of the electrode layers (12 and 14) and the width (W) of the electrodes (12 and 14) as well as the composition of the dielectric layer (16) will all effect the degree to which the signal input to the splitter (70) can be physically or spatially separated into two components output at the respective ports (74 and 76). To prevent any undesirable reflections it is desirable that the dielectric material at the region of the signal splitter (70) near the diverging points (88 and 90) of the respective output ports (76 and 74) be substantially magnetically saturated with these opposing magnetic fields (82 and 84). Stated alternatively, the area over which these magnetic fields extend should go well beyond the point at which the signals in the output ports transmission line sections spatially diverge from each other.

By virtue of the TEM mode to edge guide mode conversion effected by the opposing magnetic fields and a magnetically biased material, a radio frequency signal combiner (100) may be implemented using a virtually identical structure. FIG. 6 shows such a top view of a shape of electrodes of a section of waveguide that could function as a signal combiner. Two input ports (102 and 104) ordinarily receive or are coupled to sources of radio frequency signals, possible TEM mode signals. The area bounded by the dashed line (108) is generally subjected to ideally localized magnetic fields that directionally oppose each other. As shown in FIG. 6, the first of these magnetic fields (110) is arbitrarily shown to be oriented in a direction coming out of the plane of FIG. 6. The second of theses fields (112) is arbitrarily shown to be extending into the plane of FIG. 6 and both are ideally localized along the center line (80) such that in an ideal implementation there would be no overlap of one field into the other.

Figure 6A:
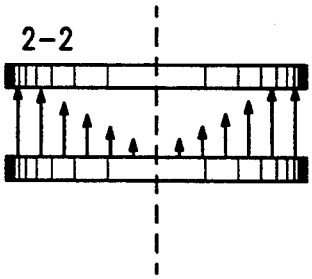

FIG. 6A shows the distribution of the electric fields in the waveguide shown in FIG. 6 through section line 2—2, which section line is shown in FIG. 6. Note that the electric field strength is greater near the outside edges of the electrodes.

By virtue of these magnetic fields extending well into the input port sections (102 and 104), the areas of these input ports that are subjected to these directionally opposed magnetic fields may be considered to be mode convertors. As such there are first and second mode converters (121 and 122) each of which convert an incoming TEM propagating mode into edge guide mode signals that recombine in the central section (120) of the frequency combiner (this central section might be considered a signal combiner area.) The directional orientation of the magnetic fields (110 and 112) is chosen to urge signals in the right-hand converter (122) to the right-hand edge of the converter (122) and to urge signals in the left-hand converter (121) to the left-hand edge of the converter (121). Signals from the two converters (121 and 122) propagate into the central converter section (120) of the combiner (100) as shown in FIGS. 6A. Upon discontinuation of the magnetic fields (110 and 112) the edge guide signals from the input ports (102 and 104) effectively recombine in the central section (120) to form one output signals, which has been reconverted to a TEM mode signal. An impedance matching section (114) couples the combiner (100) to succeeding waveguide sections at the output port (106).

Recombination of the two input signals is enhanced by the impedance converter section (114) that is a portion of the microstrip transmission line that narrow from a wide width $W_2$ to a reduced width $W_1$ as shown. It reduces reflected signals.

It is well known that to accomplish this TEM mode to edge guide mode conversion, that the material separating the electrode layers must be magnetically biased. The material separating the electrodes (16) must be a material that has a relative magnetic permeability grater that one. Materials such as ferrite, zinc manganese, and other related materials have demonstrated the desired dielectric permittivity as well as the magnetic permeability required to cause the electric signal to shift to one side or another in the presence of a magnetic field.

It would be noted that FIGS. 5 and 6 depict magnetic fields that are relatively substantially equal field strength on both sides of the center line and that the center line is very nearly at the geometric center of the splitter (70 in FIG. 5) and the combiner (100 in FIG. 6). Referring to FIG. 5, for example, if the magnetic field (82) on the left side of the center line (80) is stronger with respect to the strength of the field (84) on the right hand side of the center line (80) the degree to which the electric field will converge or concentrate at the left hand edges of the electrode layers (12 and 14) will be substantially grater than the degree to which the electrical field will aggregate itself to the right hand side of the electrodes (12 and 14) and vice versa. The amount by which a uniformly distributed TEM mode signal splits into portions at the opposing sides of the transmission lines is dependent upon the relative field strengths of the two directionally opposed magnetic fields, the proportion by which one filed covers a portion of the full width of the transmission line, the absolute width of the conductors of the transmission line, the material of the electrodes, and the composition of the dielectric layers as well. Each of these factors must be considered when construction actual devices.

For operation as a splitter, the width $W_2$ shown in FIG. 5 of the electrodes comprising the splitter, should be sufficiently wide that for given strengths of the magnetic field (82 and 84), the width is sufficient to spatially diverge the signals such that virtually no component of a signal substantially on the left hand side of the center line extends to the right hand side of the center line (80). Similarly, no signal component substantially on the right hand side should extend to the left hand side of the center line (80).

The dimensions of the devices depicted in FIGS. 5 and 6 required for suitable performance characteristics will, of course, be subject to design needs. Relative magnetic field strengths, material composition, width of the electrodes, and their composition will, as detailed above, all effect the characteristics of a radio frequency splitter or design are implemented using the TEM mode to edge guide mode conversion phenomena described above.

What is claimed is:

1. A radio frequency signal combiner having at least first and second input ports and an output port, electrically adding radio frequency signals at said first and second input ports together to produce an output signal at said output port, said combiner comprises of:

a substantially planar transmission line comprised of:

a.) a substantially planar ground layer of conductive material having first and second sides;

b.) a substantially planar layer of magnetically biasable material having first and second side, said second side of said magnetically biasable material being coupled to said first side of said ground layer; and c.) a signal layer comprised of a substantially planar layer of electrically conductive material also having first and second sides said second side of said signal layer being coupled to said first side of said magnetically biasable material:

first converter converting TEM mode waves to edge-guided mode waves comprised of a first localized magnetic field extending substantially orthogonally through said magnetically biasable material, said first magnetic field being substantially isolated to a first portion of said planar transmission line, said first converter having an input and an output;

second converter converting TEM mode waves to edge-guided mode waves comprised of a second localized magnetic field extending through said magnetically biasable material said second magnetic field extending through said magnetically biasable material said second magnetic field being directionally opposed to said first magnetic field where said first and second magnetic fields extend through said magnetically biasable material, said second converter having an input and an output;

combiner means having inputs coupled to the outputs of said first and second converter means, for coupling and combining edge-guided mode propagating waves from said first and second converter means to a single signal at an output of the combiner means.

2. The radio frequency signal combiner of claim 1 where said magnetically biased material includes ferrite.

3. The radio frequency signal combiner of claim 1 where said magnetically biased material includes zinc manganese.

4. The radio frequency signal combiner of claim 1 where said first and second magnetic fields are of substantially equal relative field strength.

5. The radio frequency signal combiner of claim 1 where said first and second magnetic fields are of substantially unequal relative field strength.

6. A radio frequency signal splitter having an input port and at least first and second outputs electrically splitting a radio frequency signal at said input into at least two output signals, said splitter comprised of:

a length of substantially planar waveguide transmission line having a length and width and comprised of at least two substantially planar and substantially parallel conductive layers coupled to the upper and lower surfaces of at least one layer of magnetically biased material that extends throughout the length and width of said transmission line, said transmission line having a first induced and localized magnetic field with a first directional orientation that is substantially orthogonal to said substantially parallel conductive layers and that extends through said magnetically biasable material, said length of transmission line having a second localized induced magnetic field with a second directional orientation opposite said first directional orientation, said second magnetic field also substantially orthogonal to and extending through said magnetically biasable material but being through a second portion of said length of transmission line, said first and second magnetic fields being substantially isolated form each other and being located to convert and separate a TEM mode wave input at said input port into at least first and second edge-guide mode waves that travel in the same relative direction and to urge said first and second edge-guide mode waves toward opposing sides of said planar waveguide transmission line and toward said first and second output ports;

first means for coupling said first edge-guided mode propagating wave to the first output port;

second means for coupling said second edge-guided mode propagating wave to the second output port.

7. The radio frequency signal splitter of claim 6 where said magnetically biased material includes ferrite.

8. The radio frequency signal splitter of claim 6 where said first and second magnetic fields are of substantially equal relative field strength throughout substantially equal regions of said means for converting TEM propagating waves.

9. The radio frequency signal splitter of claim 6 where said first and second magnetic fields are of unequal relative field strength throughout substantially equal regions of said means for converting TEM propagating waves.

10. The radio frequency signal splitter of claim 6 where said first and second magnetic fields are of equal relative field strength throughout unequal regions of said means for converting TEM propagating waves.

11. A radio frequency signal splitter having an input and at least first and second outputs electrically splitting a radio frequency signal at said input into at least two, substantially equal magnitude output signals comprised of:

a length of waveguide transmission line having a substantially rectangular cross-section, said length of waveguide transmission line having at least two substantially planar, continuous and substantially parallel conductive layers on the upper and lower surfaces of said rectangular cross sectioned waveguide, said length of transmission line having a first end coupled to a signal source and a second end coupled to a signal load, said conductive layers separated by at least one layer of ferrite extending throughout the length of transmission line, said length of transmission line having a first induced magnetic field throughout a first portion of said transmission line having a first directional orientation substantially orthogonal to said substantially parallel conductive layers extending through said conductive layers, said length of transmission line having a second induced magnetic field throughout a second portion of said transmission line with a second directional orientation opposite said first directional orientation, said second induced magnetic field also substantially orthogonal to and through said substantially parallel conductive layers, the presence and orientation of said first and second directions being chosen to separate a TEM mode wave into first and second edge-guide mode propagating waves that travel in the same relative direction and to urge said first and second edge-guide second magnetic field also substantially orthogonal to and extending through mode propagating waves toward opposing sides of said rectangular cross-sectioned waveguide that are orthogonal to the upper and lower surfaces of said waveguide; and first and second divergent waveguide sections coupled to said second end of the length of waveguide transmission line such that said first and second edge-guide mode propagating waves urged toward opposing sides of said rectangular cross-sectioned waveguide each propagate substantially through one of said first and second divergent waveguide sections.

* * * * *

UNITED STATES PATENT AND TRADEMARK OFFICE

CERTIFICATE OF CORRECTION

PATENT NO. : 5,153,538

DATED : October 6, 1992

INVENTOR(S) : Robert C. Kane

It is certified that error appears in the above-identified patent and that said Letters Patent is hereby corrected as shown below:

Col. 7, line 60, "comprises" should be --comprised--.

Col. 8, line 17, after the word "field" please delete the words "extending through said magnetically biasable material said second magnetic field".

Col. 10, line 22, delete the words "second magnetic field also substantially orthogonal to and extending through".

Signed and Sealed this

Ninth Day of February, 1993

*Attest:*

STEPHEN G. KUNIN

*Attesting Officer*

*Acting Commissioner of Patents and Trademarks*